United States Patent [19]

Whitney

[11] 4,412,628

[45] Nov. 1, 1983

[54] THERMOPLASTIC DRUM APPARATUS

[75] Inventor: Floyd A. Whitney, Riverside, Calif.

[73] Assignee: Born Free Plastics, Inc., Gardena, Calif.

[21] Appl. No.: 255,141

[22] Filed: Apr. 17, 1981

[51] Int. Cl.[3] ..... B65D 1/46; B65D 6/36; B65D 25/22

[52] U.S. Cl. ..... 220/71; 220/73; 220/85 P; 220/DIG. 1

[58] Field of Search ..... 220/71, 5 R, 85 P, 85 K, 220/73, DIG. 1

[56] References Cited

U.S. PATENT DOCUMENTS

| | | | |
|---|---|---|---|
| 3,985,257 | 10/1976 | Shaffer | 220/72 |
| 4,018,468 | 4/1977 | Lundquist | 220/71 |
| 4,022,345 | 5/1977 | Butz | 220/71 |
| 4,140,236 | 2/1979 | Uhlig | 220/71 |
| 4,149,648 | 4/1979 | Uhlig | 220/71 |
| 4,209,104 | 6/1980 | Speas | 220/71 |

*Primary Examiner*—George F. Lowrance

*Attorney, Agent, or Firm*—Nilsson, Robbins, Dalgarn, Berliner, Carson & Wurst

[57] ABSTRACT

A drum apparatus includes an injection-molded or extruded rim member formed into a ring shape and permanently attached to a blow-molded thermoplastic drum body around the top portion of the drum adjacent to the sidewall section of the drum body. The rim member includes an inwardly, radially projecting annular protuberance which is juxtaposed adjacent an annular groove in the drum just below the top of the drum. The rim member is attached to the drum while the rim member is at an elevated temperature by positioning the rim around the drum. As the temperature of the rim member decreases, the diameter of the rim member decreases causing the annular protuberance to seat into the drum's annular groove. The rim member also has a grasping beak which provides an outwardly extending support lip, a top edge providing a stacking ridge which is positioned vertically over the sidewall of the drum, and an annular seizing surface facing radially inwardly. A short chain hoist groove is formed in the bottom of the drum.

2 Claims, 6 Drawing Figures

THERMOPLASTIC DRUM APPARATUS

BACKGROUND OF THE INVENTION

The present invention relates to thermoplastic drums and in particular to thermoplastic drums which can be grasped and lifted using available mechanical lifting apparatus.

Various types of lift apparatus have been utilized for lifting metal drums. For example, the parrotbeaker apparatus grasps the flange at a point around the upper top edge of a drum and thereafter tips the drum to one side supporting the bottom portion of the drum against a circular support surface. The drum is lifted by applying a lifting force at the grasping point. Similarly, a drum may be lifted utilizing a standard handtruck by tipping the drum, slipping a support shelf of the handtruck under the bottom of the drum and then positioning a hook-like finger over the edge of the annular peripheral rim of the drum to thereby tip the drum onto the handtruck.

Drums have also been lifted utilizing forklift or sidegrabber apparatus. Such apparatus have tongs which fit around the side of the drum and underneath a suitable horizontal flange. The drum is then lifted by simply raising the tongs underneath the support flange so that a vertical force is applied to the support flange.

Still another type of lifting device is the chain hoist whereby hooks are positioned about the lip at each end of a steel drum with lifting effected by interconnecting the hooks with the chain and lifting the chain at a center location between the two ends of the drum.

With the advent of plastic drums, it has been necessary to devise specific structures to enable such drums to be lifted by one or more of the aforedescribed devices. However, special problems arise in the lifting of plastic drums because of the flexibility and resiliency of the plastic material out of which the drums are made. The present invention provides a thermoplastic drum apparatus which can be lifted by a parrotbeaker, a handtruck, a forklift, and a sidegrabber. In addition, in an optional configuration, the present invention enables the drum to be lifted utilizing a chain hoist apparatus.

Of course, it will be appreciated that the thermoplastic drums are flexible and resilient. Consequently, thermoplastic drums are subject to sidewall buckling if a heavy weight is placed on one side of the drum. This would result in the collapse of any drums stacked on the bottom drum. In order to minimize this problem, the present invention incorporates a grasping beak with a top edge defining an upper stacking ridge which is positioned vertically over the sidewall of the drum so that the weight of a drum placed on top of the stacking rim will be exerted substantially directly downward and thereby be supported by the sidewall of the lower drum with a minimum horizontal force component.

To further enable the drum sidewall to withstand buckling, it is preferred that at least the lower portion of the drum's sidewall be contoured radially inwardly between a center region of the drum and the bottom of the drum by a slight amount. This configuration will force most horizontal force components to be exerted radially outwardly on the drum making it more difficult to buckle the drum outwardly. Of course, a similarly contoured sidewall can also be provided between a center region of the drum and the top of the drum.

Finally, the rim member attached permanently and movably to the drum has a grasping beak. It will be appreciated that large drums capable of holding as much as 50 to 60 gallons will weigh as much as 750 to 800 pounds when full. Consequently, when a parrotbeaker or handtruck is used to lift the drum by grasping the rim member, tremendous stress is placed on the junction between the rim member and the drum. Hence, the necessity of an extremely strong attachment between the drum body and the rim member.

Various methods have been or can be used to make thermoplastic drums. For example, the drum may be injection-molded. Injection molding allows great detail to be incorporated while at the same time providing a rigid control over the specific configuration of features of the drum. Thus, a suitable grasping beak could be integrally molded as part of such a drum to provide the necessary strong bond. However, injection molding of the entire drum would be very expensive and therefore impractical.

Another method of molding is rotational molding whereby a mold is first made defining the external characteristics of the object to be molded. A powdered plastic is then placed in the mold and the mold rotated forcing the plastic into the particular cavities and contours of the mold under centrifugal force. The application of heat during this process melts the powder into a single molded piece. Making a suitable drum using this technique has several drawbacks, however. For example, rotational molding requires high-grade plastics which must be first ground into powder entailing additional cost. In addition, an integrally formed grasping beak will inherently have an inside concavity which allows the grasping beak to be somewhat flexible relative to the drum, thus increasing the difficulty with which the drum can be grasped and lifted. Hence, it is desird to fabricate a drum with a substantially solid grasping beak to increase the rigidity of the grasping beak relative to the drum.

The most economic means of forming a drum and the one which is most commonly used in making thermoplastic drums is the blow-molding process. However, the blow-molding process suffers from its inability to produce objects having sufficient detail. Hence, it is not possible to blow-mold a drum having an integrally formed grasping beak with a shape suitable for being grasped or otherwise used to lift the drum. Several methods have been previously devised for overcoming this problem. For example, applicant has previously used an injection-molded circular rim having a top and a side grasping flange which fits into a side and a top groove molded in the thermoplastic drum during the blow-molding process. The injection-molded ring is then snapped into place in the external molded grooves of the thermoplastic blow-molded drum. While this snap-on injection-molded ring provides a means by which the drum may be lifted utilizing the parrotbeaker, the handtruck, the forklift, or the sidegrabbers, it has been found that under certain conditions it is possible for the injection-molded ring to be pulled loose from the drum.

In another prior art device, a steel clamp ring is placed about the circumference of a blow-molded drum. However, it has been found that if the drum is dropped, the ring can pop off and be permanently bent because of the differences in the resilient characteristics of the ring and drum. Furthermore, if the drum is lifted by a parrotbeaker which grasps about the steel clamping ring, it is possible for the ring to be pulled from the drum.

In still another prior art device produced by Hedwin of New York, New York, one or more grasping beak members are injection-molded to obtain the necessary detail. The grasping beak members are then positioned at several different locations about the periphery of the drum mold. The grasping beak members are then heat-bonded to the blow-molded drum body during and as a consequence of blow-molding the heated thermoplastic utilized to form the drum against a smooth inwardly facing bonding surface of the injection-molded grasping beak members. The bonding surface, which is smooth and has a flat cross-sectional shape, is thereby bonded to the drum by the melting together of the grasping beak member and drum body.

SUMMARY OF THE INVENTION

In order to overcome the above-described disadvantages and problems, the present invention comprises a novel thermoplastic drum having a blow-molded drum body including a top section, a sidewall section extending downwardly from the radial periphery of the top section and a circumferential attachment region around the top of the sidewall section adjacent to the outer periphery of the top section, and a bottom section. The circumferential attachment region is configured to have an inwardly recessed and generally vertical annular mating section with an outwardly facing mating surface. The circumferential attachment region further includes an annular indenture or groove molded in the drum to extend radially inwardly from the mating surface at a location between the sidewall section and the mating section. The invention further includes a rim member formed in a ring shape with a generally cylindrical configuration so that the rim member has a bottom edge and a top edge which also defines a stacking ridge. The rim member has an inwardly, radially projecting protuberance extending from the bottom edge of the rim member for being positioned to extend into and seat in the annular indenture of the drum when the rim is positioned and attached to the drum body. The rim member further includes an annular inside surface extending between the inwardly projecting protuberance and the top edge of the rim member with at least a portion of the annular inside surface positioned for abutting and pressing against the annular mating surface of the mating section. Finally, the rim member includes a circumferential grasping beak portion projecting radially outwardly at a location between the top edge and the bottom edge of the rim member.

The top edge of the rim member can serve as a stacking ridge and is therefore preferably vertically aligned over the sidewall of the drum to provide a substantially solid thermoplastic support between the top of the sidewall and the horizontal stacking surface to thereby provide a structure which transmits the weight of another drum or pallet stacked on top of the top edge directly from the top edge to the sidewall with a minimum of horizontal components which may cause the drum to buckle.

Finally, in the preferred embodiment, the drum has a chain hoist groove integrally molded in the bottom section of the drum. The depth, width, length and angulation of the chain hoist groove are selected for enabling the drum to be grasped between the chain hoist and the grasping flange with a chain hoist. The length of the chain hoist groove is preferably selected so that the bottom of the thermoplastic drum is not weakened.

BRIEF DESCRIPTION OF THE DRAWINGS

A complete understanding of the present invention and of the above and other objects and advantages thereof may be gained from a consideration of the following description of the preferred embodiments taken in conjunction with the accompanying drawings in which.

DETAILED DESCRIPTION

In accordance with the invention a drum made of a thermoplastic material has a generally circumferential sidewall, a top, and a bottom, all integrally formed together utilizing a conventional thermoplastic blow-molding process. An injection-molded or extruded rim apparatus is positioned about the top portion of the circumferential sidewall of the drum. The rim is permanently affixed to the blow-molded drum by appropriately positioning the rim member while it is at an elevated temperature and then allowing the rim member to cool. The rim member contracts as it cools so that its diameter shrinks to a size sufficiently small to be permanently affixed to the drum. The particular configuration of the rim member enables the drum to be grasped and lifted utilizing a standard handtruck, forklift, side gripper, or parrotbeaker apparatus. In addition, a groove or contoured indenture may be formed to extend into the drum outside surface at a peripheral location in the bottom of the drum to provide a grasping location so that the drum can be lifted utilizing a conventional chain hoist apparatus.

While it will be appreciated that the drum may have any suitable cross-sectional shape, for simplicity the description hereafter assumes a circular cross-section for the blow-molded drum.

Figure 1:
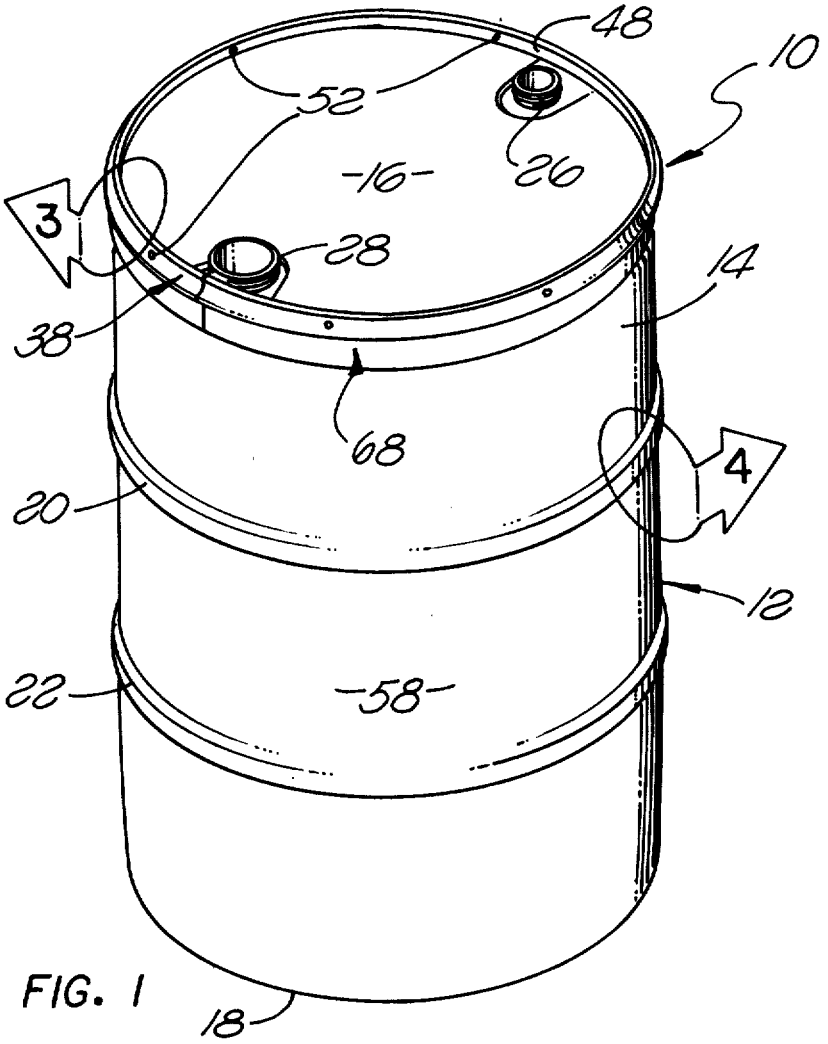
FIG. 1 is a pictorial view of a thermoplastic drum having an injection-molded rim member in position about its upper peripheral edge in accordance with the invention.
Figure 2:
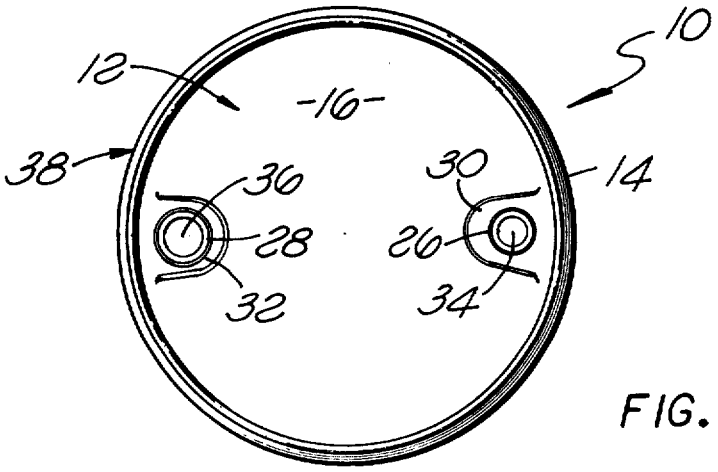
FIG. 2 is a top plan view of the thermoplastic drum of FIG. 1.
Figure 4:
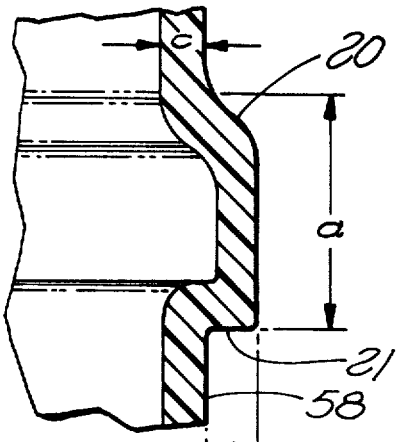
FIG. 4 is a cross-sectional plan view through section 4 of FIG. 1.

Referring now to FIGS. 1 and 2, a drum apparatus 10 includes a drum body 12 having a cylindrical sidewall 14, a top 16, and a bottom 18 where the region around the top of the sidewall 14 adjacent to the periphery of the top 16 defines a circumferential attachment region 68. In the preferred embodiment, two spaced-apart annular hoops 20 and 22 are integrally molded to protrude outwardly from the outside surface 58 of the cylindrical sidewall 14 of the drum. The hoops 20 and 22 are formed during the blow-molding process by providing annular depressions in the drum mold and may have any suitable configuration to facilitate rolling or lifting of the drum apparatus 10. Of course, the number of integrally molded hoops may be varied without departing from the essence of the invention. One or both of the hoops may have a cross-sectional configuration adapted to facilitate lifting of the drum as well as rolling of the drum. For example, referring to FIG. 4, a preferred cross-sectional shape for hoop 20 includes a drum portion protruding outwardly a distance "b" of about 5/16 and having a length "a" of about 1½ to 2 inches. The hoop is provided with a substantially horizontal down-facing support surface 21 so that the drum can be lifted by a forklift whose tines are positioned on opposite sides of the drum under the support surface 21. In the preferred embodiment the horizontal width of the support surface is less than the width of the grasping beak 80 of the rim member to be described hereafter.

The cylindrical sidewall 14 of the drum body 12 preferably tapers inwardly at least toward the bottom 18 of the drum body 12. A similar taper may also be provided toward the top 16 of the drum body 12. Alternatively, one or both of the sidewall 14 portion below the annular hoop 22 or above the annular loop 20 may be inwardly tapered.

The inward taper or curvature of the sidewall 14 gives added strength to the drum body 12 in the case where several drum apparatus 10 are stacked on top of one another.

Referring to FIG. 2 in conjunction with FIG. 1, the top 16 of the drum body 12 and the cylindrical sidewall 14 are integrally molded. In the illustrated embodiment of the invention, a pair of bungs 26 and 28 are also integrally molded to extend upwardly out of molded depressions 30 and 32, respectively. The bung holes 34 and 36 defined by the bungs 26 and 28, respectively, provide a means by which fluids can be inserted into the drum and removed from the drum.

In accordance with the invention, a rim member 38 is positioned annularly about the top of the sidewall 14 of the drum 10. The rim member 38 may be made by injection molding or extruding a length of plastic material having a particular cross-section to be described hereafter. While the length of plastic is still hot, its two ends 40 and 42 are abutted against each other and bonded to form a ring. The rim member 38 may be positioned around the drum 10 adjacent the attachment region 68 either before or after the two ends 40 and 42 of the rim member 38 are joined and bonded into the ring shape. Further, the rim member 38 is heated and hence in an expanded state when the rim member (whether or not already formed into a ring shape) is positioned adjacent the corner region so that as the rim member 38 cools it will shrink causing the inside diameter of the ring-shaped rim member 38 to decrease to press against and become attached to the sidewall of the drum 10. This enables the ring-shaped rim 38 to firmly and permanently grasp the drum 10. The ring 38 may have an upstanding grasping portion 48 with one or more drain holes 52 extending therethrough to prevent the accumulation of water or other liquid on the top of the drum apparatus 10.

In one specific embodiment, a 55-gallon drum in accordance with the invention has a height of about 36¼ inches and a diameter of about 23½ inches. The drum body 12 has a thickness "c" (FIG. 4) which varies from a minimum of about 0.135 inches to about ⅜ inches or more.

In the above-described specific embodiment of the invention, the sidewalls of the drum below the lower hoop 22 and above the upper hoop 20 are inwardly sloped or tapered about one degree from the vertical. Of course, the angle at which the sidewall is inwardly tapered may be varied or even eliminated without departing from the essence of the invention.

Figure 5:
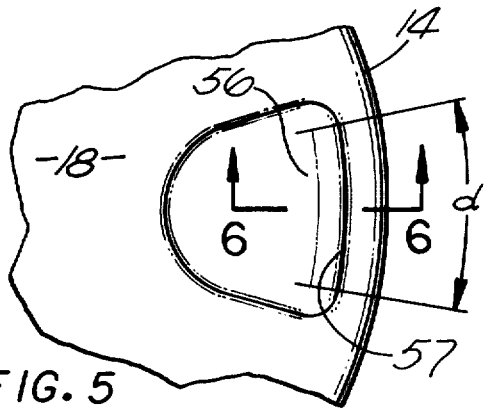
FIG. 5 is a bottom plan view of the thermoplastic drum in accordance with one embodiment of the invention.
Figure 6:
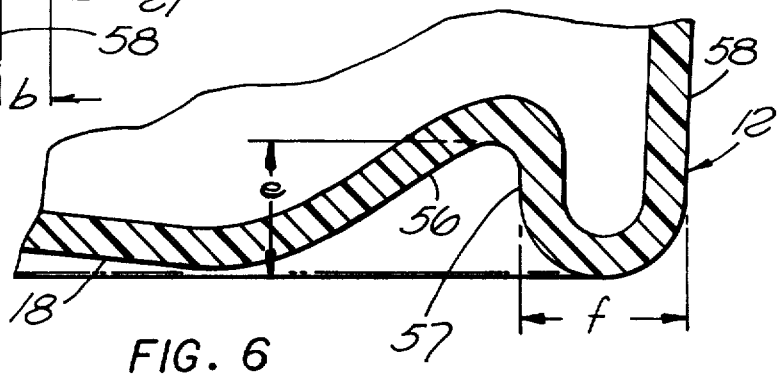
FIG. 6 is a partial cross-sectional plan view through section 6—6 of FIG. 5.

Referring now more particularly to FIGS. 5 and 6, the bottom 18 is provided with a chain hoist groove 56 in the external surface of the drum body 12. The groove 56 has a generally circularly shaped grasping surface 57 which is angled sufficiently sharply to enable the chain hoist to grasp and lift the drum. In the preferred embodiment, the surface 57 is approximately perpendicular relative to the bottom 18 of the drum 10. The length of the chain hoist groove is sufficiently small so as not to affect the structural strength of the drum but sufficiently long to enable easy interconnection of a chain hoist at the groove. For example, in one embodiment, the length "d" of the groove is about two to six inches long and has a depth "e" of about ⅝ inch with the space "f" between the grasping surface 57 of the groove and the vertical extension of the outside sidewall surface 58 of the drum being approximately one inch. Of course, it will be appreciated that the size, configuration and location of the chain hoist groove 56 can be varied in order to accommodate the chain hoist apparatus and consequently various alterations in the dimensions may be made without departing from the scope of the invention.

Figure 3:
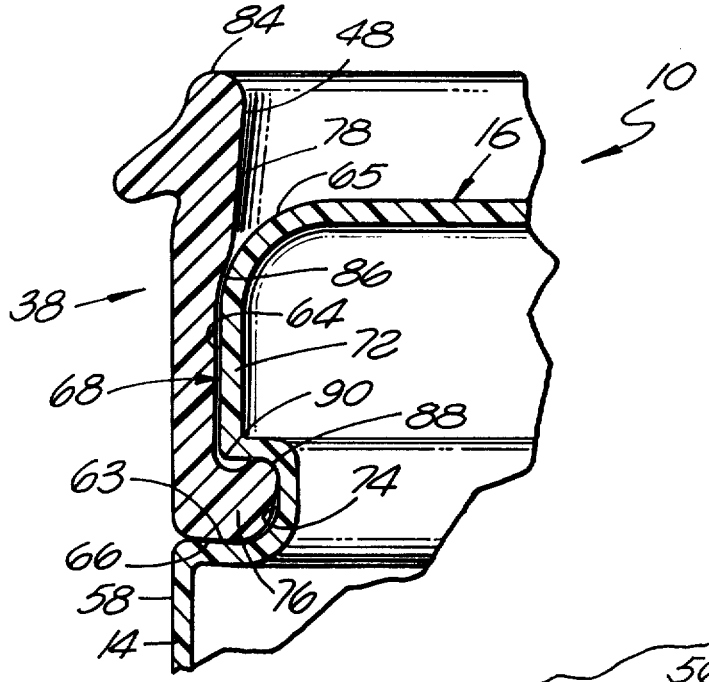
FIG. 3 is a partial cross-sectional plan view through section 3 of FIG. 1.

Referring now to FIG. 3, the thermoplastic drum 10 includes a circumferential attachment region 68 which extends downwardly from the peripheral edge region 65 of the top section 18 of the drum 10. The circumferential attachment region 68 is generally recessed radially inwardly relative to the surface 58 of the sidewall 14 and includes an inwardly recessed, generally vertical annular mating section 72 having an outer mating surface 64. The attachment region 68 further has an annular indenture 74 extending radially inwardly from the mating surface 64 and positioned at a location between the mating section 72 and the sidewall 14. The top of the mating section 72 curves at approximately a 90-degree angle from the vertical to the horizontal to thereby interconnect the mating section 72 to the peripheral edge region 65 of the top section 18. In addition, the outer surface 58 of the sidewall 14 curves inwardly at approximately 90 degrees to define a flat support surface 63 which extends into the annular indenture 74.

The invention further comprises an annular rim or ring 38 which is formed into a generally cylindrical shape having a top edge 84 and a bottom edge 66 with an annular radially projecting protuberance 76 extending inwardly and positioned adjacent to the bottom edge 66. In one embodiment, the protuberance 76 has an upwardly projecting annular lip 88 disposed to modify the shape of the cross-section of the protuberance 76.

The annular rim 38 also defines an annular inside surface 78, at least a portion of which comprises an abutting portion 86 which abuts against the mating surface 63 of the attachment region 68. An annular portion 48 of the rim 38 also extends upwardly above the top section 18 of the drum 10 when the rim 38 is in place about the attachment region 68 of the drum.

Finally, an annularly disposed grasping beak 80 extends from the outer surface of the rim 38 at a selected location between the top edge 84 of the rim 38 and the bottom edge 66 of the rim 38. The grasping beak 80 preferably has a nose-like cross-sectional shape with an annular top surface 83 which extends downwardly and outwardly from the vertical wall of the rim 38 and an underneath annular surface 81 which similarly extends downwardly and outwardly from the vertical wall of the rim member 38.

When the rim 38 is attached to the attachment region 68 of the drum 10, the bottom edge 66 of the rim 38 will be adjacent to and in contact with the generally flat support surface 63 of the drum 10 with the annular protuberance 76 extending into the annular indenture 74. The end of the protuberance 76 moves into and presses against the innermost part of the annular indenture 74 as the rim member cools during the attachment process. In the preferred embodiment, the upwardly projecting lip 88 presses against the top horizontal surface of the annular indenture 74 with an annular space 90 existing between the protuberance 76 and the annular indenture 74 between the lip 88 and the rim abutting portion 86. The space 90 provides a degree of impact-absorption resistance. In addition, the lip 88 provides a hook-like structure to facilitate better grasping between the rim and the drum. The abutting portion 86 of the annular inside surface 78 then presses against and molds to the shape of the mating surface 64 of the attachment region 68 of the drum 10.

In operation, the rim 38 may be initially formed by extrusion or any other suitable means as a single straight member having a cross-section substantially as shown in FIG. 3. The straight rim 38 thus has a first and a second end. The first and second ends are then curved around and bonded to one another to form a ring-shaped member while the plastic from which the rim member 38 is made is at an elevated temperature and the plastic material hence in an expanded state. The two ends of the length of the material forming the rim 38 may be joined either before the rim is positioned around the top of the drum or during the process of positioning the rim around the top of the drum. Of course, it will be appreciated that a ring member may be formed as a single piece by injection-molding without the necessity of joining and then bonding two ends of a length of the rim member. In any event, and regardless of how the rim is positioned around the top of the drum, the rim, when it is so positioned, has an elevated temperature relative to the temperature of the drum and hence the plastic material from which the rim 38 is formed is in an expanded state. Consequently, the diameter of the rim member is larger than it would be when the temperature was not in an elevated state. As the temperature of the rim member thereafter decreases, the diameter will shrink and the rim will press firmly against the mating surface 64 of the drum 10 with the annular protuberance 76 pressing into the annular indenture 74.

As previously indicated, the slight inward curvature of the sidewall 14 further facilitates the minimization of buckling of the drum since any horizontal force component which may occur will be applied radially outwardly—a direction in which the drum will resist buckling because of its greater strength and support capabilities with regard to outwardly directed horizontal force components.

While various details of specific embodiments have been particularly described, it will be appreciated that the foregoing and other changes in form and details can be made without departing from the spirit and scope of the invention.

What is claimed is:

1. A thermoplastic drum comprising:

a performed drum body having a top, a bottom, and a cylindrical sidewall between the top and bottom, the sidewall having a radially recessed region adjacent the top of the drum and a cylindrical indenture between the recessed region and the remaining non-recessed portion of the sidewall, the recessed region being radially recessed by a first distance; and a rim attached to the recessed region of the drum body, said rim having a cylindrical wall, a grasping beak projecting away from the cylindrical wall about its circumference and a protuberance projecting inwardly from the cylindrical wall into the indenture, the cylindrical wall having a thickness substantially the same as the first distance so that the cylindrical wall of the rim is in colinear alignment with the non-recessed portion of the sidewall, the inwardly projecting protuberance of the rim having an annular, upwardly projecting lip extending from the protuberance for modifying the cross-sectional shape of the protuberance whereby an enclosed annular space is formed between the recessed region of the sidewall and the protuberance adjacent to the lip.

2. A thermoplastic drum comprising:

a preformed drum body comprising:

a top;

a bottom;

a cylindrical sidewall extending upwardly from the bottom toward the top and having an annular upper terminus, the sidewall further having a cylindrical outer surface;

a radially recessed annular abutment region extending down from the top toward the bottom, the abutment region defining an outfacing annular abutment surface radially inset a first distance relative to the outer surface of the sidewall;

a radially recessed annular indenture region defining an indenture and having a downfacing surface extending radially inwardly from the lowermost edge of the abutment surface and an inner surface extending axially down from the innermost edge region of the downfacing surface; and an upfacing radially projecting annular support surface extending inwardly from the upper terminus of outer surface of the sidewall into the indenture and connecting to the lowermost edge region of the inner surface; and a rim comprising:

a cylindrical wall having an annular, infacing wall surface positioned to abut against the abutment surface of the abutment region of the drum body, the cylindrical wall having a thickness substantially the same as the first distance;

a protuberance projecting radially inwardly from the lowermost edge region of the infacing wall surface into the indenture;

a cylindrical outfacing wall surface opposite the infacing wall surface;

a stacking surface defining the top of the cylindrical wall; and a downfacing force transfer surface defining the bottom of the cylindrical wall and extending radially inwardly from the lowermost edge of the outfacing wall surface and positioned in contacting, force transfering relationship to the upfacing support surface whereby the stacking surface and the cylindrical wall of the rim are in linear alignment with the cylindrical sidewall of the drum whereby an axial force component applied to the stacking surface is transferred axially through the cylindrical wall portion of the support surface axially aligned over the upper terminus of the sidewall whereby formation of a torquing component of the axial force along the force transfer surface is minimized.

* * * * *